US005379693A

United States Patent [19]

Hoffmann et al.

[11] Patent Number: 5,379,693

[45] Date of Patent: Jan. 10, 1995

[54] WELDED TUBULAR PRINTING PLATE, AND THE METHOD OF MAKING

[75] Inventors: Eduard Hoffmann, Bobingen; Johann Winterholler, Friedberg; Wolfgang Prem, Ustersbach; Herbert Stöckl, Augsburg, all of Germany

[73] Assignee: MAN Roland Druckmaschinen AG, Offenbach am Main, Germany

[21] Appl. No.: 986,425

[22] Filed: Dec. 4, 1992

[30] Foreign Application Priority Data

Dec. 11, 1991 [DE] Germany ..... 4140768

[51] Int. Cl.[6] ..... B41F 27/12

[52] U.S. Cl. ..... 101/375; 101/216; 101/378; 101/395; 101/DIG. 36; 29/895.23; 492/18; 219/121.64

[58] Field of Search ..... 101/141, 142, 216, 217, 101/375, 376, 378, 382.1, 383, 389.1, 415.1, 395, 401.1, DIG. 36; 492/18, 48, 58; 219/121.63, 121.64; 29/895.21, 895.23

[56] References Cited

U.S. PATENT DOCUMENTS

| | | | |
|---|---|---|---|
| 758,486 | 4/1904 | Such | 101/375 |
| 1,963,745 | 6/1934 | Ingersoll et al. | 29/895.21 |
| 4,286,031 | 8/1981 | Kuehnle et al. | 101/216 |
| 4,727,806 | 3/1988 | Green, Sr. | 101/415.1 |
| 4,762,064 | 8/1988 | Moore | 101/415.1 |
| 4,913,048 | 4/1990 | Tittgemeyer | 101/375 |
| 4,964,338 | 10/1990 | Fantoni et al. | 101/415.1 |
| 5,052,120 | 10/1991 | Lubberts | 101/DIG. 36 |
| 5,138,923 | 8/1992 | Kent et al. | 492/21 |

FOREIGN PATENT DOCUMENTS

| | | | |
|---|---|---|---|
| 0009360 | 4/1980 | European Pat. Off. . | |
| 0526867A1 | 2/1993 | European Pat. Off. . | |
| 2700118 | 7/1977 | Germany . | |
| 2045953 | 4/1978 | Germany | 101/415.1 |
| 3532099 | 3/1987 | Germany . | |
| 3633155 | 4/1988 | Germany . | |
| 32154 | 3/1979 | Japan | 219/121.64 |
| 578777 | 8/1946 | United Kingdom . | |

OTHER PUBLICATIONS

Braun, Alexander: "Der Tiefdruck" ("Gravure Printing"), 1952, published by Polygraph Verlag GmbH, Frankfurt/Main, p. 91.

*Primary Examiner*—Edgar S. Burr
*Assistant Examiner*—Stephen R. Funk
*Attorney, Agent, or Firm*—Frishauf, Holtz, Goodman & Woodward

[57] ABSTRACT

A circumferentially continuous printing plate, which has the advantage over clamp plates that a clamping arrangement and groove in a plate cylinder can be eliminated, is formed by rolling a flat printing plate into tubular or sleeve form and welding the end edges together, preferably by a neodymium-YAG laser weld, resulting in a narrow, less than 1 mm wide, weld seam (2) having upper and lower concave sides, or by adhering the end edges to an underlay saddle (9), the plate can be coated and imaged when flat or after having been rolled and installed on a plate cylinder (37) of a printing machine. Interengaging projection-and-recess elements (4, 6; 14, 16) are formed on the plate (1, 1') and on the cylinder (37), respectively, to ensure lateral and circumferential register.

13 Claims, 4 Drawing Sheets

WELDED TUBULAR PRINTING PLATE, AND THE METHOD OF MAKING

Reference to related patent and application, the disclosure of which is hereby incorporated by reference:

U.S. Pat. No. 4,913,048, to Tittgemeyer U.S. Serial No. 07/823,303, filed Jan. 21, 1992, Prem, now U.S. Pat. No. 5,168,808 assigned to assignee of the present application.

Reference to related disclosures:

German Patent 27 00 118, Julian;

German Patent Publication Document 36 33 155, to Saueressig.

German Patent Publication Document 35 32 099, to Green sen.

Braun: "DER TIEFDRUCK" ("GRAVURE PRINTING"), published by Polygraph, Frankfurt-/Main, 1952, pp. 90, 91.

FIELD OF THE INVENTION

The present invention relates to an offset printing form of metallic material, particularly adapted for application to a form or plate cylinder of a rotary offset printing machine, and to a method of its manufacture.

BACKGROUND

The most used printing form in rotary offset printing machines is a pre-coated aluminum plate. Its biggest advantage is simplicity and speed in manufacture. Also substantially used are multi-metal plates, mostly formed of three metals, to constitute tri-metal plates. Usually, either aluminum or sheet steel is used as the carrier substrate metal. These types of plates are used particularly for printing with high numbers of printed runs, and where high stress resistance and long life is important. The excellent surface characteristics of these plates can be enhanced, even, by additionally anodizing the surfaces.

These printing plates, generally, are circumferentially discontinuous. Opposite edges of the plates, as they are wrapped around a plate cylinder, are formed with holes to engage in register pins of a clamping arrangement located in an axially extending groove of the printing cylinder. The printing form is centered on the engagement pins and hooked into the cylinder groove. Prior to hooking the printing form into the groove, the edge is bent at an angle of about 90°. The trailing end of the plate is also introduced into the cylinder groove, and a clamping arrangement tightly, circumferentially clamps the plate on the cylinder. To attach such a plate to a cylinder requires a groove extending over the entire width of the cylinder and clamping segments which are located within the cylinder groove. The printing forms begin and end in the region of the groove. This interruption in the circumference prevents the formation of endless images and, additionally, causes problems in operation. The cylinder is subjected to vibrations and oscillations due to the groove, and the clamping apparatus therein. This limits the printing speed and the oscillations interfere with best printing quality.

THE INVENTION

It is an object to improve printing forms of the well-known type, and to achieve improved print quality with higher rotary speeds of the printing cylinders, and to eliminate the oscillatory or recurring vibration and oscillation loading on the printing machine cylinders and bearing structures and associated apparatus arising due to the presence of the groove.

Briefly, the printing plate is made of metallic material, as well known and as customary. In accordance with a feature of the invention, the leading and trailing edges of the printing plate, after having been cut to size, are so connected that the offset printing plate is formed into a circumferentially continuous tube or sleeve. This tube or sleeve is fitted on the printing machine cylinder in such a way that it is frictionally engaged for printing, yet can be released from the printing cylinder. The arrangement has the advantage that the outer circumference of the printing plate will be completely smooth. Register arrangements can be located on the plate cylinder as well as on the printing plate to ensure that circumferential as well as lateral register is retained.

The leading and trailing edges of the printing plate, which can be imaged, for example by photo exposure to subject matter robe printed in flat form, are connected together either by welding or by adhesion to an underlying coupling saddle. The offset printing form can be attached to a plate cylinder which does not have an axial clamping groove, with clamping segments therein as illustrated, for example, in the referenced German Patent 27 00 118, to Julian, or on a cylinder as described in the referenced patent application assigned to the assignee of the present invention, U.S. Ser. No. 07/823,303, filed Jan. 21, 1992, to Prem, now U.S. Pat. No. 5,168,808.

By use of compressed air, an offset printing form which is circumferentially continuous can be fitted on the plate cylinder. In working or printing condition, it is tightly located on the cylinder, yet can be released from the cylinder, without damage or destruction thereof, so that the printing plate can be re-imaged and re-used. The elimination of clamping grooves and clamping elements not only is a substantial decrease in the cost of making the printing plate cylinder, but also substantially reduces vibration and oscillation thereof. It is only necessary to provide register arrangements so that the printing sleeve or form is properly fitted on the underlying plate cylinder. Markers formed on the plate cylinder, and matching markers on the thin offset printing form, can be used; preferably, the elements are interengaging register pins on the plate cylinder which engage in matching recesses, such as holes or notches, on the printing form.

It is a specific feature of the present invention that customary commercial offset printing plates can be used, and that already existing printing plate copies can be continued to be used, without change, except for possibly trimming off excess plate material previously inserted into the clamping groove. Grooveless or continuous printing permits inexpensive manufacture of the plate cylinders, since the clamping groove and the attachment clamps no longer need be made; the printing quality is improved, and higher printing speeds become possible.

DRAWINGS

DETAILED DESCRIPTION

Figure 1:
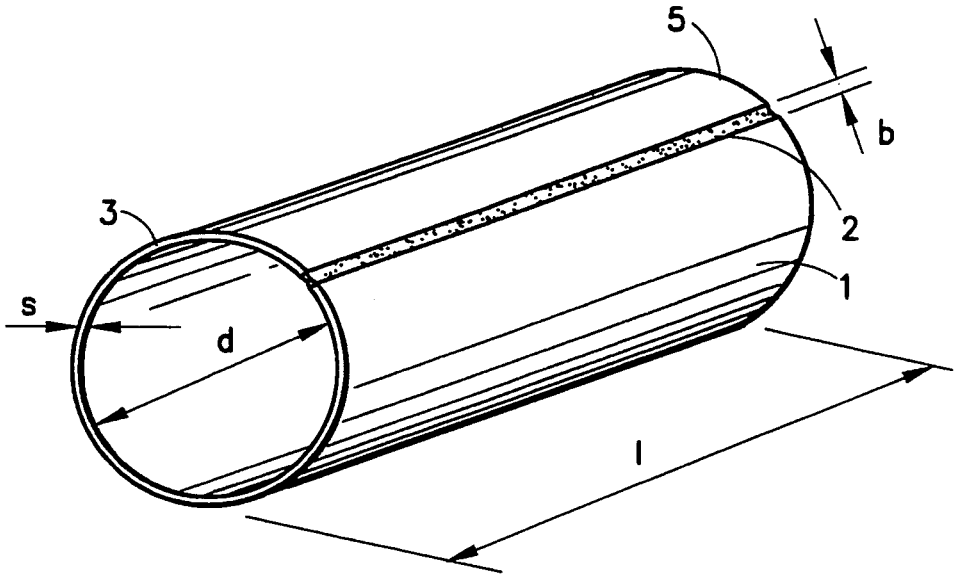
FIG. 1 is a perspective view of a sleeve shaped offset printing form.

The offset printing form 1 has a thickness s of about 0.3 mm, see FIG. 1. It is made of a metallic material, and formed in a circumferentially continuous sleeve having a diameter d of about 30 cm. The axial width 1 is about 1.6 m. The material can be aluminum or a multi-metal, for example a tri-metal. The ends 1*a* and 1*b* are axially, that is, transversely welded together. The welded form has edge regions 3 and 5. The weld seam 2, preferably, has a width b in the order of about 0.7 mm, preferably less.

Figure 2:
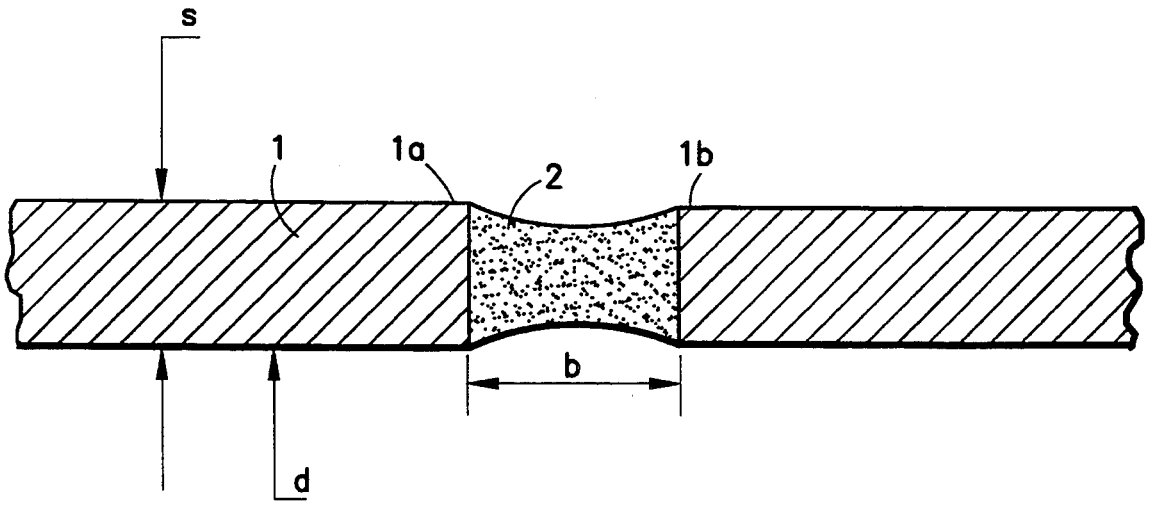
FIG. 2 is a detailed fractional cross-sectional view of a welded printing form.
Figure 3:
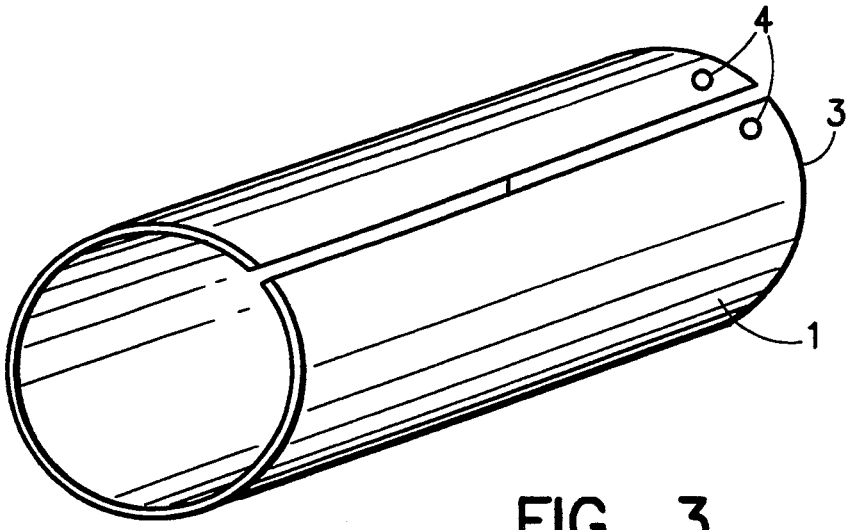
FIG. 3 is an offset printing form blank, before the leading and trailing edges are connected, with one embodiment of a register arrangement.
Figure 4:
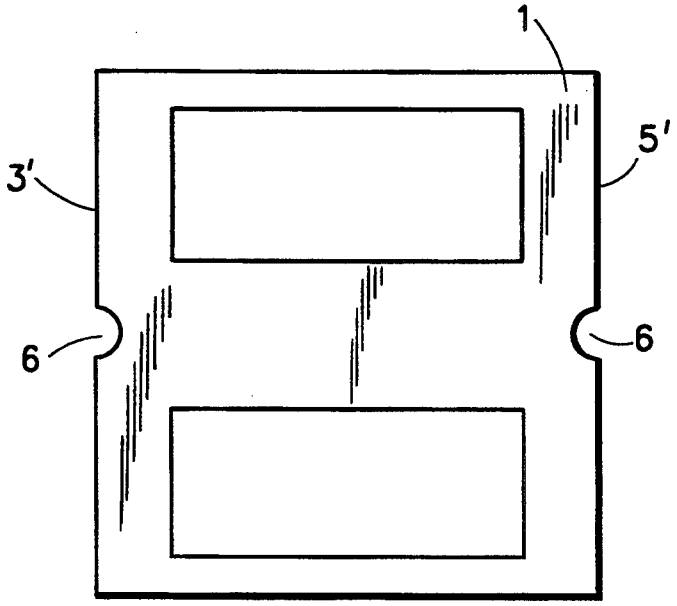
FIG. 4 illustrates a flat offset printing form, before being rolled, with another embodiment of a register arrangement.
Figure 5:
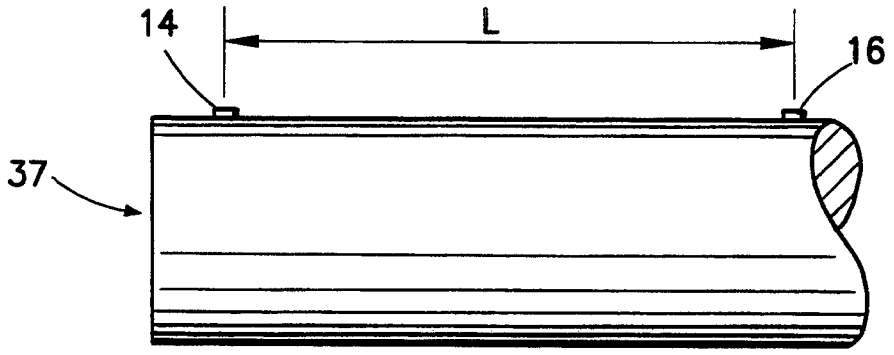
FIG. 5 is a side view of a printing machine cylinder with register markers thereon, omitting all features not necessary for an understanding of the present invention.

As best seen in FIG. 2, the cross section of the weld seam 2 is concave at the upper and lower side, or outer or inner side of the circular welded form 1, respectively. The offset printing form 1, thus, will have an outer continuous circumference, free from any discontinuities. FIG. 3 illustrates this form, before it is connected together. FIG. 3 further illustrates register holes 4 formed at edge regions 3 of the form 1, shaped as through-bores, which can fit over register pins 14, 16 (see FIG. 5) forming cylinder register elements, and shown in FIG. 5 in greatly exaggerated size, for better visibility. FIG. 4 illustrates register notches 6 formed at the side edges 3', 5' of the printing form, which interengage with register pins, for example pins like the pins 14, 16 (FIG. 5) secured to the plate cylinder 37. Holes 4 or notches 6 are form register elements.

The printing form is made in sequential steps. In accordance with a feature of the invention, a printing plate is first cut to size, circumferentially as well as axially. At least two edge surfaces 3', 5' (FIG. 4) or an edge region 3 is formed with the register elements 4, 6, by suitably punching the plate. The now essentially rectangular plate-shaped blank is formed in a circular sleeve and clamped in a welding apparatus, and the longitudinal welding seam 2 is formed therein. In accordance with a preferred feature of the invention, a neodymium-YAG laser is used to carry out the weld. The laser power is preferably controlled, using either continuous or pulsed operating mode. By suitably controlling the laser power, which can be done as well known in laser controls, a precisely reproducible energy can be applied to the printing form 1 to form a precisely controlled reproducible welding seam 2. Use of a neodymium-YAG laser places only low heat loading on the thin offset printing form, thus preventing heat deformation or twist of the material to be welded. This welding process is preferred, since other thermal processes tend to distort the thin printing form. The welding process is so carried out that the seam 2 will have the shape shown in FIG. 2, that is, be concave at both sides.

Figure 7:
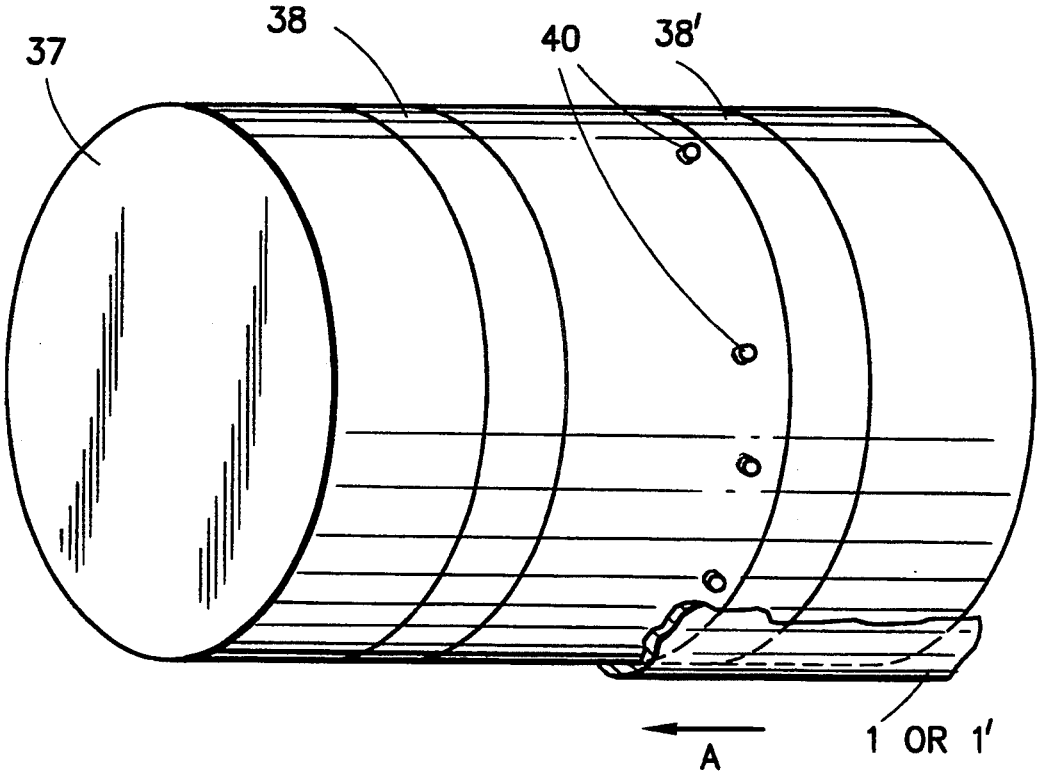
FIG. 7 illustrates an arrangement for applying a circumferentially continuous printing cylinder sleeve over a plate cylinder.

The thin printing form can then be expanded by compressed air and, when so expanded, pushed on the cylinder 37 (FIG. 7).

Coating of the printing form 1, and exposure to provide the subject matter thereon, can be carried out either before the end portions 1*a*, 1*b* are connected together, or afterwards. Coating and exposing the flat form—see FIG. 4—can be carried out outside of the printing machine; alternatively, the printing form 1 can be coated and exposed after application on the cylinder 37 (FIG. 7), for example when already installed in the printing machine.

Figure 6:
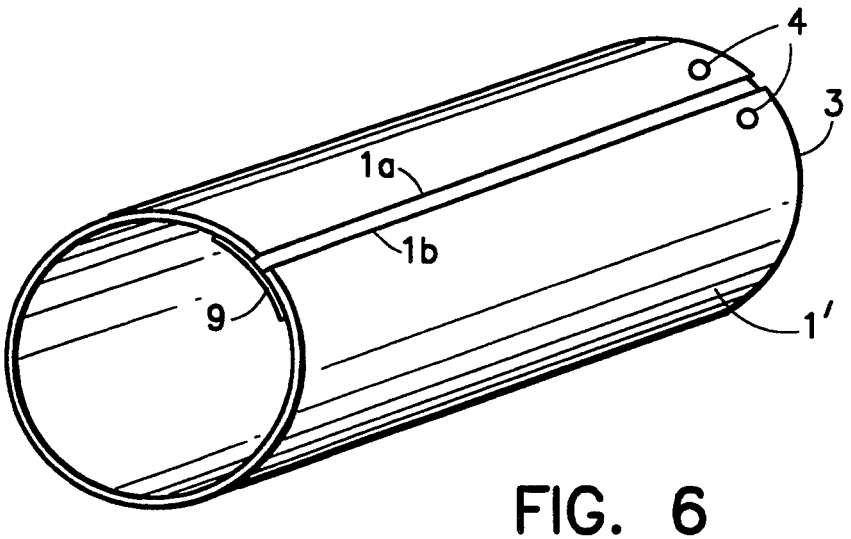
FIG. 6 illustrates another offset printing plate before joining of the leading and trailing edges, in which the end portions of the plate are adhesively connected to a coupling saddle.

In accordance with another embodiment of the invention, the end portions 1*a*, 1*b* are connected together by an underlying saddle 9, to which they are adhered. FIG. 6 illustrates the saddle 9 before the edges 1*a*, 1*b* are fitted against each other. Preferably, the beginning portion, for example portion 1*a*, is adhered to one-half of the axially extending underlying saddle, the printing form then bent into circular, tubular shape, and the second end and the adjacent portion thereof is adhered to the other half of the longitudinal saddle 9. The abutting end portions of the printing plate form 1 can be additionally adhered against each other. The saddle 9, together with the printing form, is then fitted on the plate cylinder 37.

The basic principle of the present invention, thus, is to provide a commercial, well-known printing plate made of a metallic material and to shape this printing plate into a sleeve and connect the edges to form a complete circumferentially continuous sleeve which can be secured to a printing cylinder 37, so that, when in operating condition in a printing machine, it is held by frictional engagement with the underlying plate cylinder of the printing machine, and in appropriate register. Yet, it can be readily released from the plate cylinder. The sleeve-type printing plate, thus, has a continuous circumference, without any free or loose end portions and can be placed over a circumferentially continuous plate cylinder, without a clamping groove.

The referenced U.S. application Ser. No. 07/823,303, filed Jan. 21, 1992, to Prem, now U.S. Pat. No. 5,168,808, describes the mounting of continuous sleeves.

Referring now to FIG. 7:

FIG. 7, generally, shows the core structure or cylinder 37, with two schematically shown circumferential grooves and expansion rings 38, 38' thereon. The figure is drawn axially compressed.

Compressed air, when emitted from openings 40—of which only a few are shown—formed in the plate or core cylinder 37, expands form 1 or 1', so that it can be slipped on the core cylinder 37 over the resulting air cushion or air pillow. The relatively thin wall thickness of the sleeve ensures inherent sealing of the ring gap as the sleeve 1 or 1' is slid on the core 37, which gap occurs between the sleeve and the surface of the core. Thus, air can escape only in the direction of movement of the sleeve at the facing end or edge, and an air cushion will build up in the resulting ring gap. When using relatively thick-walled sleeves, e.g. of aluminum, and expanding them by compressed air, it has been found that a substantial amount of air introduced into the ring gap escapes in both directions from the facing ends of the cylinder. This is a problem in mounting the sleeves. Due to the substantial loss of compressed air, it is difficult to build up an air cushion to a sufficient extent, so that assembling the sleeve over the core becomes difficult. By selective partial expansion of only one ring 38', one end of the composite of the sleeve and the core is constricted with respect to a pressure medium, so that a suitable air cushion can be obtained, which facilitates assembly of a sleeve over the core and thus assembly of the final printing cylinder.

The sequence of re-sleeving a cylinder, thus, is this. A new sleeve 1 or 1' is fitted over the cylinder 37, and compressed air emitted from the openings 40 which, of course, are circumferentially located although only a few are shown in FIG. 7 for simplicity. After the sleeve 1, 1' has been pushed in the direction of the arrow A beyond the openings 40, the expansion ring 38' is expanded to the extent that compressed air from the openings 40 can no longer readily escape in the axial direction, in FIG. 7 towards the right, over the right end portion of the cylinder 37 from the openings 40, thus maintaining better control over the air cushion as the sleeve 1 or 1' is pushed over the core structure 37.

Various changes and modifications may be made, and any features disclosed and described herein may be used with any others, within the scope of the concept of the present invention.

A suitable tri-metal printing plate has the following metal layers:

Copper for colour-carrying areas and chromium for wafer-carrying areas in connection with an iron support.

We claim:

1. A method of making a circumferentially continuous offset printing plate or form for a plate cylinder (37) of a rotary offset printing machine, in which the side edge regions of the plate cylinder (37) are formed with at least one cylinder register element (14, 16), said method comprising:

cutting an essentially rectangular plate of printing plate or printing form material of aluminum, tri-metal or other multi-metal to circumferential and width dimensions of the plate cylinder (37), to provide a cut plate defining leading and trailing edges **(1*a*, 1*b*) and side edges (3, 5)**;

forming the cut plate with at least one form register element (4, 6) at a location or locations which match the location of the at least one cylinder register element (14, 16);

coating the cut plate with a photo-sensitive layer to permit application of subject matter to be printed on the coated plate;

rolling the cut plate into tubular form to then define an inner plate side and an outer plate side;

clamping the tubular cut plate in a workpiece holder of a welding machine with the at least one form register element in predetermined position on the workpiece holder; and forming a long welding seam (2) axially of the tubular formed cut plate to join the leading and trailing edges; and controlling the welding seam formation such that the welding seam, in cross section, will have essentially concave shape at the outer plate side and at the inner plate side of the tubular formed cut plate.

2. The method of claim 1, wherein the step of coating the plate with a photo-sensitive layer and applying the subject matter to be printed on the plate is carried out after the cutting step and before the step of rolling the cut plate into tubular form.

3. The method of claim 1, wherein said step of forming the cut plate with the at least one form register element comprises forming at least one register recess (4, 6) by punching the cut plate, before being rolled.

4. The method of claim 1, wherein said step of forming the welding seam (2) comprises welding the leading and trailing end edges of the plate with a neodymium-YAG laser.

5. The method of claim 1, further including the step of fitting the welded tubular plate on the cylinder, by expanding the welded tubular plate by compressed air, and pushing it on the plate cylinder (37).

6. The method of claim 1, wherein said step of coating the plate with a photo-sensitive layer and applying the subject matter to be printed on the plate is carried out after the plate has been rolled into tubular form and welded.

7. The method of claim 6, wherein the step of forming the cut plate with the at least one form register element comprises forming at least one register recess (4, 6) by punching the cut plate.

8. The method of claim 6, wherein said step of forming the welding seam (2) comprises welding the leading and trailing end edges of the plate with a neodymium-YAG laser.

9. The method of claim 6, further including the step of fitting the welded tubular plate on the cylinder by expanding the welded tubular plate by compressed air, and pushing it on the plate cylinder (37).

10. A circumferentially continuous offset printing plate form (1, 1') for application on a plate cylinder (37) of a rotary offset printing machine, comprising:

a circumferentially continuous, axially seamed tube or sleeve (1, 1') of printing plate material of aluminum, tri-metal or other multi-metal, deformed into tubular shape from a flat, essentially rectangular plate or sheet (1) of said printing plate material of aluminum, tri-metal or other multi-metal, defining leading and trailing edges, and side edges, and in which, upon deformation, the leading and trailing edges **(1*a*, 1*b*) meet an axial weld seam (2) securely welding said leading and trailing edges together to define the tube or sleeve, with a circumferentially continuous outer surface and having said axial weld seam at said leading and trailing edges, wherein said weld seam, in cross section, has essentially concave shape both at an outer plate side and at an inner plate side of the tube or sleeve, said tube or sleeve being dimensioned with respect to the cylinder for frictionally engaging the circumference of the cylinder (37)** when in a printing position in the printing machine, while being releasable from the cylinder;

at least one form register element (4, 6) formed on at least one of said side edges (3, 5) of said tube or sleeve, and adapted for engagement with at least one cylinder register element (14, 16) located on at least one edge portion of the plate cylinder (37); and wherein said circumferentially continuous tube or sleeve is coated with a photosensitive layer.

11. The printing plate of claim 10, in combination with the plate cylinder wherein said at least one cylinder register element is formed as a projecting pin (14, 16), and the at least one form register element comprises at least one hole (4) punched into said tube or sleeve, fitting over said at least one projecting pin (14, 16).

12. The printing plate of claim 10, in combination with the plate cylinder wherein said at least one cylinder register element is formed as a projecting pin (14, 16); and the at least one form register element comprises at least one notch (6) formed in at least one of said side edges (3, 5) of said tube or sleeve fitting over said projecting pin (14, 16).

13. The printing plate of claim 10, in combination with the plate cylinder wherein the at least one cylinder register element comprises projecting means (14, 16); and said at least one form register element comprises a recess means (4, 6) formed on or adjacent to at least one of said side edges (3, 5) of said tube or sleeve.

* * * * *